United States Patent [19]

Smith

[11] Patent Number: 4,589,854

[45] Date of Patent: May 20, 1986

[54] NESTED BALLOON HOLDER

[76] Inventor: Billie D. Smith, 2745 Waltrip La., Concord, Calif. 94518

[21] Appl. No.: 671,992

[22] Filed: Nov. 16, 1984

[51] Int. Cl.[4] ..... A63H 3/06; G09F 21/06

[52] U.S. Cl. ..... 446/223; 40/214

[58] Field of Search ..... 446/220, 221, 222, 223, 446/224, 225, 226; 248/156, 146; 40/212, 214; 244/33

[56] References Cited

U.S. PATENT DOCUMENTS

| | | | |
|---|---|---|---|
| 816,106 | 3/1906 | Lindsay | 446/224 X |
| 857,097 | 6/1907 | McCormack | 446/224 |
| 1,570,642 | 1/1926 | Reed | 446/224 |
| 1,994,202 | 3/1935 | Sarsfield | 446/222 X |
| 2,409,166 | 10/1946 | Tracy et al. | 244/33 |
| 2,663,968 | 12/1953 | Longino | 446/224 X |
| 2,664,667 | 1/1954 | Burroughs | 446/222 |
| 2,840,948 | 7/1958 | Stickley | 446/223 |
| 3,009,594 | 11/1961 | Anson | 446/222 X |
| 3,428,319 | 2/1969 | Engle | 248/156 |
| 3,591,975 | 7/1971 | Terc | 446/225 |
| 4,145,838 | 3/1979 | Mason | 446/220 X |

FOREIGN PATENT DOCUMENTS

| | | | |
|---|---|---|---|
| 2379302 | 9/1978 | France | 446/226 |

*Primary Examiner*—Robert A. Hafer
*Assistant Examiner*—D. Neal Muir
*Attorney, Agent, or Firm*—Limbach, Limbach & Sutton

[57] ABSTRACT

A nested balloon holder comprising an inner balloon holder and an outer balloon holder. The inner balloon holder includes a generally frusto-conical, funnel-like balloon anchoring member, the balloon anchoring member having an upper perimeter and a lower perimeter, and an outwardly-extending perimetrical rim, the perimetrical rim being positioned adjacent the upper perimeter. The outer balloon holder is a generally frusto-conical, funnel-like member that is capable of securely receiving the inner balloon holder in a nested fashion. The frusto-conical outer member has an upper perimetrical rim and a lower perimeter, whereby the upper perimetrical rim of the inner holder is positioned adjacent the upper perimetrical rim of the outer holder.

5 Claims, 3 Drawing Figures

NESTED BALLOON HOLDER

DESCRIPTION

1. Technical Field

This invention relates to balloon holders and more particularly, to nested balloon holders.

2. Background Art

Balloon holders for anchoring and attaching balloons are common in the art. One such prior art balloon holder includes a generally frusto-conical, funnel-like balloon anchoring member. The balloon anchoring member has an upper perimeter and a lower perimeter. An outwardly extending rim is positioned adjacent the upper perimeter of the anchoring member. In addition, a tubular member, positioned adjacent the lower perimeter, is adapted to securely receive a balloon stem. Moreover, the balloon anchoring member may include at least one slot to facilitate the anchoring of an inflated balloon. Such a prior art balloon holder is generally shown as the top member, with an inflated balloon in phantom, of FIG. 2.

Prior art balloon holders are deficient in several aspects. One such aspect is its relatively short tubular member. Such a short tubular member does not facilitate the attachment of various decorations. In addition, such prior art balloon holder does not have sufficient stability to be used in an environment such as water. Due to its instability, the balloon will not generally stay upright.

DISCLOSURE OF THE INVENTION

In view of the prior art, it is a major object of the present invention to provide a novel nested balloon holder.

It is another object of the present invention to provide a novel nested balloon holder that is capable of receiving a plurality of decorative attachments.

It is a further object of the present invention to provide a novel nested balloon holder that is stable in water.

It is a still further objection of the present invention to provide a novel nested balloon holder that is, with its decorative attachments, easy to store or transport.

In order to accomplish the above and still further objects, the present invention provides a novel nested balloon holder. The nested balloon holder comprises an outer balloon holder, an inner balloon holder nested within the outer holder, a balloon stabilizing member positioned within the outer holder, and a balloon stem member.

More particularly, the inner balloon holder includes a generally frusto-conical, funnel-like balloon anchoring member, the anchoring member having an upper perimeter and a lower perimeter. The inner balloon holder also includes an outwardly-extending, gripping, perimetrical rim. The perimetrical rim, positioned adjacent the upper perimeter of the anchoring member, is adapted to facilitate efficacious mounting and dismounting of the inner balloon holder. Further, inner balloon holder includes an axially-extending, tubular member, the tubular member being adapted to securely receive the balloon stem member.

The outer balloon holder includes a generally frusto-conical, funnel-like member that is capable of securely receiving the inner balloon holder in a nested fashion. The frusto-conical, outer member has a perimetrical rim, an axially-extending tubular member, and a circular trough-like depression. The upper perimetrical rim is adapted to be positioned adjacent the upper perimetrical rim of the inner holder. The tubular member is adapted to receive both the tubular member of the inner holder and the balloon stem member. The circular depression, positioned radially from the outer tubular member, is adapted to receive the balloon stabilizing member.

The balloon stabilizing member is a ring-like, tubular device that is adapted to be received in the circular depression of the outer holder.

One advantage of the present invention is that a plurality of decorative attachments may be secured to the nested balloon holder.

Another advantage of the present invention is that the nested balloon holder has sufficient stability to stay upright in a liquid environment.

A further advantage of the present invention is that the nested balloon holder, with its decorative attachments, is easy to store or transport.

Other objects, features, and advantages of the present invention will appear from the following detailed description of the best mode of a preferred embodiment, taken together with the accompanying drawings.

BEST MODE FOR CARRYING OUT THE INVENTION

Figure 1:
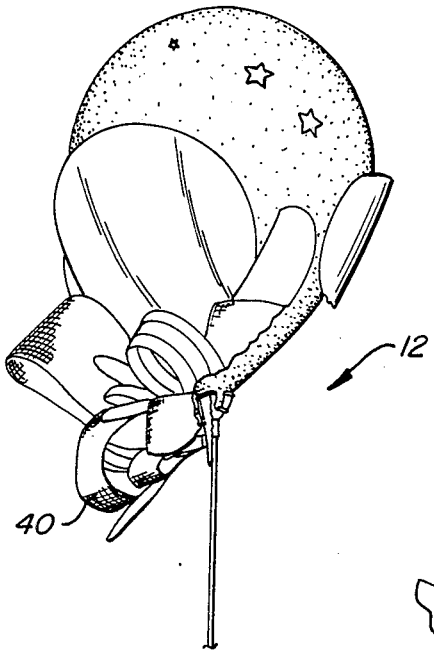
FIG. 1 is a perspective, partially broken, view of the novel nested balloon holder of the present invention as it supports an inflated balloon and a plurality of decorative attachments.
Figure 2:
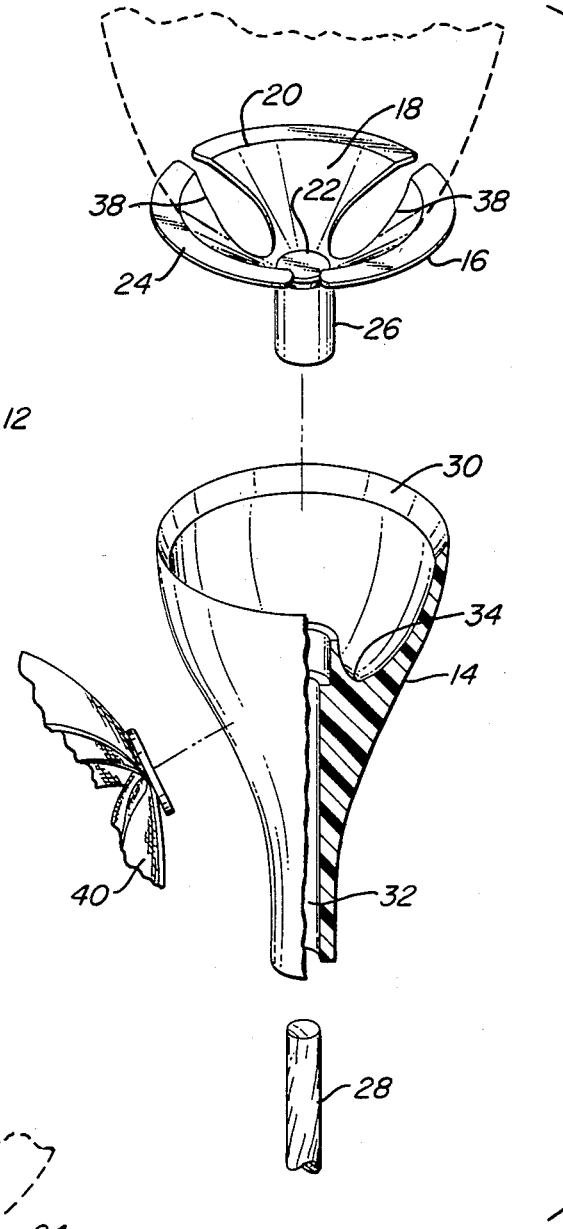
FIG. 2 is an exploded, partially broken, perspective view of the novel nested balloon holder of FIG. 1.

Referring to FIG. 1, there is shown a nested balloon holder, generally designated 12, as it supports an inflated balloon and a plurality of decorative attachments. As best shown in FIG. 2, nested balloon holder 12 comprises an outer balloon holder 14 and an inner balloon holder 16 that is nested within outer balloon holder 14.

More particularly, inner balloon holder 16 includes a generally frusto-conical, funnel-like balloon anchoring member 18. Anchoring member 18 has an upper perimeter 20 and a lower perimeter 22. Inner balloon holder 16 also includes an outwardly-extending, gripping, perimetrical rim 24. Perimetrical rim 24 is positioned adjacent upper perimeter 20. Rim 24, generally referred to as a grip ridge, is adapted to facilitate the efficacious mounting and dismounting of inner holder 16. Further, inner holder 16 includes an axially-extending, tubular member 26. Tubular member 26 is adapted to securely receive a balloon stem member 28.

Figure 3:
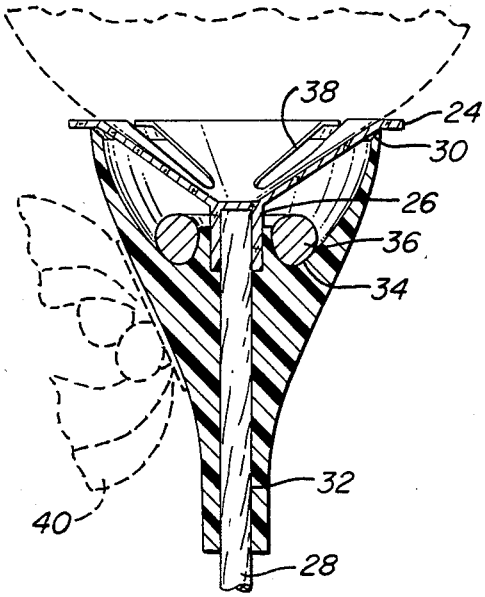
FIG. 3 is a cross-section view of the novel nested balloon holder of FIG. 1, with an inflated balloon and a decorative attachment in phantom.

Outer balloon holder 14 is a generally frusto-conical, funnel-like member that is capable of securely receiving inner balloon holder 16 in a nested fashion. The frusto-conical, outer holder 14 has an upper perimetrical rim 30, an axially-extending tubular member 32, and a circular trough-like depression 34. Upper perimetrical rim 30 is adapted to be positioned adjacent upper perimetrical rim 24 of inner holder 16, as best shown in FIG. 3. Tubular member 32 is adapted to receive both tubular member 26 of inner holder 16 and balloon stem member 28. Circular depression 34, positioned radially from tubular member 32, is adapted to receive a balloon stabilizing member 36.

In the preferred embodiment, balloon stabilizing member 36 is a ring-like, tubular device that is adapted to be received in circular depression 34 of outer holder 14. In addition, frusto-conical anchoring member 18 of inner holder 16 includes a plurality of radially extending anchoring slots 38, as best shown in FIG. 2. Moreover, a plurality of decorative attachments 40 are secured to outer balloon holder 14. Such decorative attachments may be petal-like decorations, ribbon-like decorations, or streamer-like decorations, as best shown in FIG. 1.

In use, an outer nested balloon holder 14 is first decorated with colorful attachments 40. The decorations may be attached with conventional adhesives. The decorated outer balloon holder 14 may then be transported to the desired consumer.

At the work site, a balloon is inflated with a conventional gas. The open end of the inflated balloon is then pulled through a slot 38 of inner balloon holder 16. The open end of the inflated balloon need not be tied or knotted since the expansive effect of the inflated balloon, forcing it against anchoring member 18, closes the opening, not shown. Inner balloon holder 16, with the inflated balloon, is then mounted within outer holder 14 in a nested fashion. As best shown in FIG. 3 perimetrical rim 24 of inner holder 16 is positioned atop perimetrical rim 30 of outer holder 14. In addition, tubular member 32 of outer holder 14 receives tubular member 26 of inner holder 16.

If the consumer wishes to use a balloon stem member 28, such a stem may be fed through tubular member 32 of outer holder 14 and be received by tubular member 26 of inner holder 16. If the consumer wishes to float the balloon in a liquid environment such as a pond, balloon stabilizing member 36 may be placed within circular depression 34 of outer holder 14. Furthermore, inner balloon holder 16 having the inflated balloon anchored thereon may be dismounted from outer holder 14 to permit the storage or retransportation of outer holder 14 with its decorative attachments. Moreover, inner balloon holder 16 may be mounted on a replacement outer holder 14 if the previous outer holder had been damaged.

It will be apparent to those skilled in the art that various modifications may be made within the spirit of the invention and the scope of the appended claims.

I claim:

1. A nested balloon holder, comprising
an outer balloon holder,
an inner balloon holder nested within said outer holder, and
a balloon stabilizing member positioned within said outer holder,
said inner balloon holder including
a general frusto-conical, funnel-like balloon anchoring member, said anchoring member having an upper perimeter, a lower perimeter, and balloon anchoring means,
a perimetrical rim extending from said upper perimeter of said anchoring member to facilitate efficacious finger-grasping of said inner holder during mounting and dismounting of said inner holder, and
a tubular member extending from said lower perimeter; said outer balloon holder including
a generally frusto-conical, funnel-like member that is capable of securely receiving said inner holder in a nested fashion,
said frusto-conical, outer holder having an upper perimetrical rim, a tubular member, and a circular trough-like depression,
said upper perimetrical rim is positioned adjacent to said upper perimetrical rim of said inner holder,
said outer holder tubular member receives said tubular member of said inner holder, and
said circular depression, positioned radially from said outer holder tubular member, receives said balloon stabilizing member; and
said balloon stabilizing member, a toroidal weight member, is securely received in said circular depression of said outer holder so as to uniformly stabilize said nested balloon holder.

2. The nested balloon holder as claimed in claim 1, wherein
said frusto-conical anchoring member includes a plurality of radially-extending anchoring slots.

3. A nested balloon holder comprising
an outer balloon holder,
an inner balloon holder nested within said outer holder, and
a balloon stem member,
said inner balloon holder including
a generally frusto-conical, funnel-like balloon anchoring member, said anchoring member having an upper perimeter, a lower perimeter, and balloon anchoring means,
a perimetrical rim extending from said upper perimeter of said anchoring member to facilitate efficacious finger-grasping of said inner holder during mounting and dismounting of said inner holder, and
a tubular member extending from said lower perimeter to securely receive said balloon stem member; and said outer balloon holder including
a generally frusto-conical, funnel-like member that is capable of securely receiving said inner balloon holder in a nested fashion,
said frusto-conical, outer holder having an upper perimetrical rim, and a tubular member,
said upper perimetrical rim is positioned adjacent to said upper perimetrical rim of said inner holder, and
said outer holder tubular member receives both said tubular member of said inner holder and said balloon stem member.

4. The nested balloon holder as claimed in claim 3, wherein
said frusto-conical anchoring member includes a plurality of radially-extending anchoring slots.

5. The nested balloon holder as claimed in claim 1, 2, 3, or 4, wherein said outer balloon holder further comprises external decorations selected from the group consisting of
a plurality of petal-like decorations,
a plurality of bow-like decorations, and
a plurality of streamer-like decorations.

* * * * *